US010385888B2

(12) United States Patent
Knoblich et al.

(10) Patent No.: US 10,385,888 B2
(45) Date of Patent: Aug. 20, 2019

(54) SLEEVE HOLDER FOR A HYDRAULIC CYLINDER

(71) Applicant: Caterpillar Global Mining Europe GmbH, Lünen (DE)

(72) Inventors: Christian Knoblich, Stuttgart (DE); Lothar Markowski, Recklinghausen (DE); Sabine Figge, Essen (DE); Jaroslaw Werner, Unna (DE)

(73) Assignee: Caterpillar Global Mining Europe GmbH, Lunen (DE)

( * ) Notice: Subject to any disclaimer, the term of this patent is extended or adjusted under 35 U.S.C. 154(b) by 222 days.

(21) Appl. No.: 15/300,581

(22) PCT Filed: Mar. 27, 2015

(86) PCT No.: PCT/EP2015/000664
§ 371 (c)(1),
(2) Date: Sep. 29, 2016

(87) PCT Pub. No.: WO2015/154856
PCT Pub. Date: Oct. 15, 2015

(65) Prior Publication Data

US 2017/0108016 A1 Apr. 20, 2017

(30) Foreign Application Priority Data

Apr. 7, 2014 (DE) ..... 20 2014 002 977

(51) Int. Cl.
*F01B 7/20* (2006.01)
*F15B 15/14* (2006.01)
(Continued)

(52) U.S. Cl.
CPC ..... *F15B 15/1438* (2013.01); *F15B 15/16* (2013.01); *E21D 15/15* (2013.01);
(Continued)

(58) Field of Classification Search
CPC .. F15B 15/1409; F15B 15/1438; F15B 15/16; B66F 3/28
See application file for complete search history.

(56) References Cited

U.S. PATENT DOCUMENTS 234,407 A * 11/1880 Jay ..... F15B 15/1438 92/128
1,424,233 A * 8/1922 Berry ..... B66F 3/28 92/51
(Continued)

FOREIGN PATENT DOCUMENTS

CN 201013386 1/2008
CN 201310364 9/2009
(Continued)

OTHER PUBLICATIONS

International Search Report dated Jan. 26, 2016, issued in PCT/EP2015/000664 (3 pages).

*Primary Examiner* — Michael Leslie

(57) ABSTRACT

A hydraulic cylinder is disclosed. The hydraulic cylinder may have an outer cylindrical tube including an open end, a first female threaded portion, and a second female threaded portion. The hydraulic cylinder may also have a movable element received in the outer cylindrical tube through the open end. Further, the hydraulic cylinder may have a sleeve holder engaged with the first female threaded portion to seal an annular space between the outer cylindrical tube and the movable element. The sleeve holder may have a first male threaded portion mating with the first female threaded portion. In addition, the hydraulic cylinder may have a locking ring engaged with the second female threaded portion to secure the sleeve holder to the outer cylindrical tube. The locking ring may have a second male threaded portion mating with the second female threaded portion.

10 Claims, 7 Drawing Sheets

(51) Int. Cl.

| | |
|---|---|
| ***F15B 15/16*** | (2006.01) |
| *E21D 15/15* | (2006.01) |
| *E21D 15/44* | (2006.01) |
| *E21D 15/51* | (2006.01) |
| *E21D 15/56* | (2006.01) |

(52) U.S. Cl.
CPC ..... *E21D 15/44* (2013.01); *E21D 15/51* (2013.01); *E21D 15/56* (2013.01); *F15B 15/1461* (2013.01)

(56) References Cited

U.S. PATENT DOCUMENTS

| | | | | |
|---|---|---|---|---|
| 1,459,432 | A * | 6/1923 | Armstrong | B66F 3/28 92/52 |
| 1,673,386 | A * | 6/1928 | Zabriskie | B66F 3/28 417/559 |
| 3,136,230 | A | 6/1964 | Buckley | |
| 4,211,151 | A * | 7/1980 | Wallischeck | F15B 15/1457 92/165 R |
| 4,337,692 | A | 7/1982 | Sifri et al. | |
| 5,715,740 | A | 2/1998 | Sims | |
| 6,615,705 | B2 | 9/2003 | Reinelt et al. | |
| 7,228,787 | B2 | 6/2007 | Zins | |

FOREIGN PATENT DOCUMENTS

| | | |
|---|---|---|
| CN | 202611723 | 12/2012 |
| DE | 1525962 | 5/1969 |
| DE | 202005017073 | 12/2005 |
| EP | 1069261 | 1/2001 |
| GB | 2313626 | 3/1997 |
| JP | S50-023121 | 3/1975 |
| WO | WO 2014/008715 | 1/2014 |

* cited by examiner

SLEEVE HOLDER FOR A HYDRAULIC CYLINDER

CLAIM FOR PRIORITY

This application is a U.S. National Phase entry under 35 U.S.C. § 371 from PCT International Application No. PCT/EP2015/000664, filed Mar. 27, 2015, which claims benefit of priority of German Patent Application No. 202014002977.6 filed Apr. 7, 2014, all of which are incorporated herein by reference.

TECHNICAL FIELD

The present disclosure generally relates to a sleeve holder for a hydraulic cylinder, in particular, sleeve holders for hydraulic cylinders used as a pit prop or a moving cylinder unit in underground mining.

BACKGROUND

In underground mining, hydraulic cylinders are frequently used as telescopic pit props or moving cylinders in self-advancing supports.

In such hydraulic cylinders, a sleeve holder is commonly screwed into a cylinder tube or, in case of a telescopic pit prop, an outer cylindrical tube and an inner cylindrical tube. The sleeve holder serves to support and guide the inner cylindrical tube and/or the piston rod, and receives and transfers forces from the piston rod to the cylinder tube, or from the piston rod to the inner cylindrical tube and from the inner cylindrical tube to the outer cylindrical tube. In addition, the sleeve holder seals the annular space formed between the corresponding elements. Further, the sleeve holder commonly includes grooves and the like for receiving sealing gaskets for sealing the annular space.

It has been found that, as a consequence of the rough operating conditions underground, the sleeve holder may come loose due to the forces applied to and transferred by the same. Therefore, it is necessary to secure the sleeve holder to the cylinder tube of a cylinder and the outer and/or inner cylindrical tube of a telescopic pit prop. An example for a method of securing a sleeve holder to a hydraulic cylinder is shown in U.S. Pat. No. 6,615,705 B2.

The disclosed systems and methods are directed at least in part to improving known systems.

SUMMARY OF THE DISCLOSURE

In one aspect, the present disclosure relates to a hydraulic cylinder. The hydraulic cylinder comprises an outer cylindrical tube including an open end and an outer circumferential groove adjacent to the open end, and a movable element slideably received in the outer cylindrical tube through the open end. A sleeve holder is threadably engaged with the outer cylindrical tube at the open end to seal an annular space formed between the outer cylindrical tube and the movable element. The sleeve holder includes at least one tangential bore aligned with the outer circumferential groove. The hydraulic cylinder further comprises at least one locking pin received in the outer circumferential groove and the at least one tangential bore to secure the sleeve holder to the outer cylindrical tube.

In another aspect, the present disclosure relates to a sleeve holder for a hydraulic cylinder, the hydraulic cylinder including an outer cylindrical tube having an open end and a movable element slideably received in the outer cylindrical tube through the open end. The sleeve holder comprises a male threaded portion configured to threadably engage a female threaded portion formed in the outer cylindrical tube at the open end, and at least one tangential bore formed in the sleeve holder. The at least one tangential bore is configured to be aligned with a circumferential groove formed in the outer cylindrical tube and to receive a locking pin to secure the sleeve holder to the outer cylindrical tube.

According to another aspect, the present disclosure relates to a hydraulic cylinder comprising an outer cylindrical tube including an open end, a first female threaded portion having a first pitch, a second female threaded portion having a second pitch oppositely directed to the first pitch, the second female threaded portion being disposed closer to the open end than the first female threaded portion, and a movable element slideably received in the outer cylindrical tube through the open end. A sleeve holder is threadably engaged with the first female threaded portion to seal an annular space formed between the outer cylindrical tube and the movable element. The sleeve holder includes a first male threaded portion mating with the first female threaded portion. A locking ring is threadably engaged with the second female threaded portion to secure the sleeve holder to the outer cylindrical tube. The locking ring includes a second male threaded portion mating with the second female threaded portion.

In a further aspect, the present disclosure relates to a sleeve holder assembly for a hydraulic cylinder, the hydraulic cylinder including an outer cylindrical tube having an open end and a movable element slideably received in the outer cylindrical tube through the open end. The sleeve holder assembly comprises a sleeve holder configured to threadably engage a first female threaded portion formed in the outer cylindrical tube. The sleeve holder includes a first male threaded portion having a first pitch. The sleeve holder assembly further comprises a locking ring configured to threadably engage a second female threaded portion formed in the outer cylindrical tube to secure the sleeve holder to the outer cylindrical tube. The locking ring includes a second male threaded portion having a second pitch oppositely directed to the first pitch.

According to another aspect, the present disclosure relates to hydraulic cylinder comprising an outer cylindrical tube including an open end and a female threaded portion at the open end, and a movable element slideably received in the outer cylindrical tube through the open end. A sleeve holder is threadably engaged with the female threaded portion to seal an annular space formed between the outer cylindrical tube and the movable element. The sleeve holder includes a male threaded portion mating with the female threaded portion and a tapered outer surface extending toward the open end of the outer cylindrical tube to create a wedge-shaped annular space between the sleeve holder and the outer cylindrical tube that widens toward the open end. A tapered locking ring is inserted into the wedge-shaped annular space and attached to the outer cylindrical tube to secure the sleeve holder to the outer cylindrical tube. The tapered locking ring includes a tapered inner surface mating with the tapered outer surface of the sleeve holder.

In a further aspect, the present disclosure relates to a sleeve holder assembly for a hydraulic cylinder, the hydraulic cylinder including an outer cylindrical tube having an open end and a movable element slideably received in the outer cylindrical tube through the open end. The sleeve holder assembly comprises a sleeve holder configured to threadably engage a female threaded portion in the outer cylindrical tube. The sleeve holder includes a male threaded portion formed at a first end of the sleeve holder in an axial direction and a tapered outer surface spaced apart from the male threaded portion and extending toward an opposite second end of the sleeve holder in the axial direction. The sleeve holder assembly further comprises a tapered locking ring including a tapered inner surface mating with the tapered outer surface of the sleeve holder and a plurality of attachment portions for receiving a plurality of fastening elements to attach the tapered locking ring to the open end of the outer cylindrical tube, to thereby secure the sleeve holder to the outer cylindrical tube.

Other features and aspects of the present disclosure will be apparent from the following description and the accompanying drawings.

DETAILED DESCRIPTION

The following is a detailed description of exemplary embodiments of the present disclosure. The exemplary embodiments described herein are intended to teach the principles of the present disclosure, enabling those of ordinary skill in the art to implement and use the present disclosure in many different environments and for many different applications. Therefore, the exemplary embodiments are not intended to be, and should not be considered as a limiting description of the scope of protection. Rather, the scope of protection shall be defined by the appended claims.

The present disclosure may be based in part on the realization that, in case fastening elements such as screws or brackets are used to secure the sleeve holder to the hydraulic cylinder, the loads applied to the sleeve holder may become so large that the screws or the welds used to attach the brackets may break. Further, the provision of fastening elements such as heavy-type dowel pins or of self-locking threads on the sleeve holder may complicate the assembly of the sleeve holder. In accordance with the exemplary sleeve holders described below, the present disclosure provides sleeve holders which are easy to install and, at the same time, durable.

Figure 1:
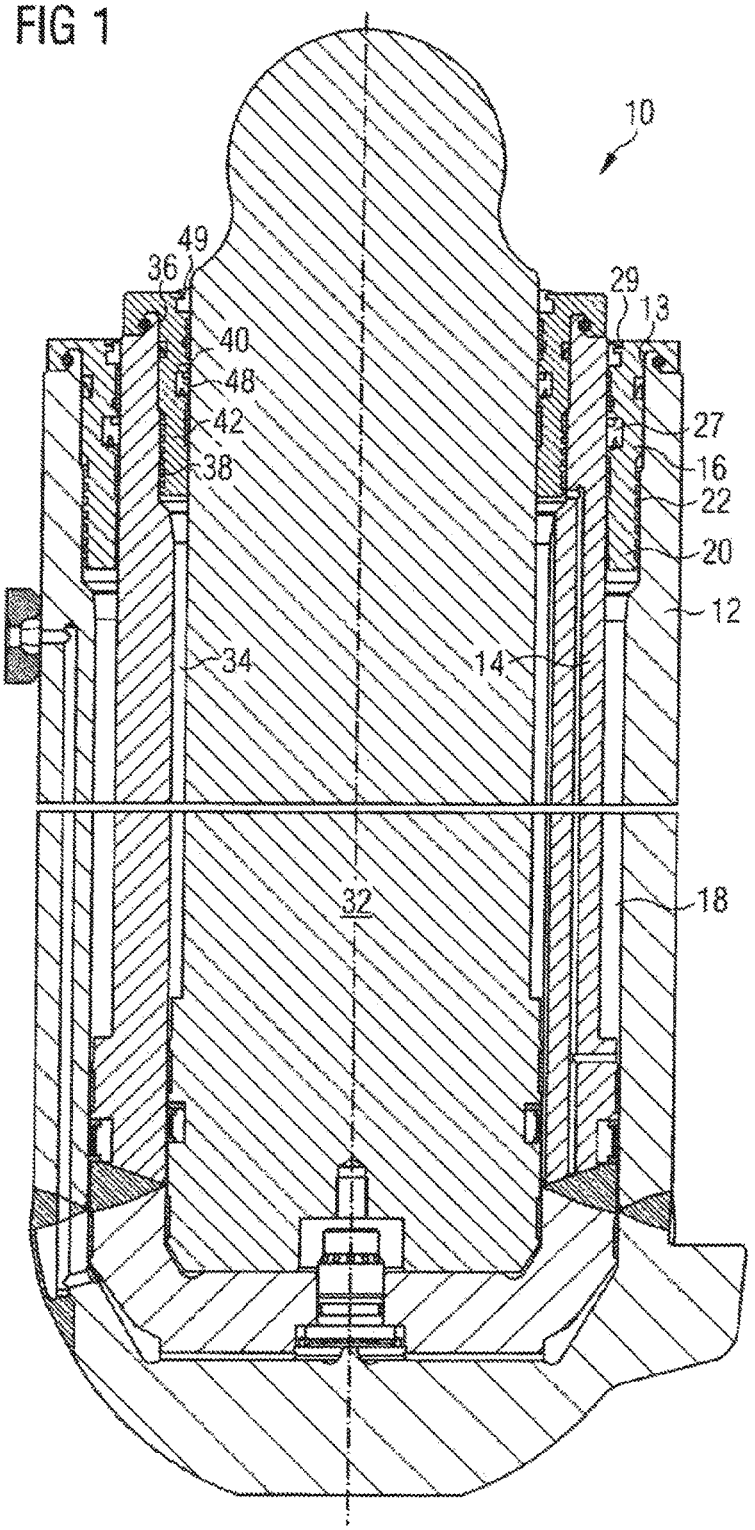
FIG. 1 shows a cross-sectional view of an exemplary hydraulic cylinder including a sleeve holder in accordance with the present disclosure.

Referring now to the drawings, FIG. 1 shows an exemplary hydraulic cylinder 10 including a first sleeve holder 16 and a second sleeve holder 40 in accordance with the present disclosure. In the example shown in FIG. 1, hydraulic cylinder 10 is configured as a telescopic hydraulic cylinder or pit prop including an outer cylindrical tube 12, an inner cylindrical tube 14 slideably disposed in outer cylindrical tube 12, and a piston rod 32 slideably disposed in inner cylindrical tube 14. An annular space 18 is formed between outer cylindrical tube 12 and inner cylindrical tube 14, and an annular space 34 is formed between inner cylindrical tube 14 and piston rod 32.

Outer cylindrical tube 12 includes an open end 13 at one end of the same in an axial direction. Further, outer cylindrical tube 12 includes an outer circumferential groove 24 (see FIG. 4) extending around outer cylindrical tube 12 adjacent to open end 13. In the example shown in FIG. 1, circumferential groove 24 is formed in an annular projection 47 (see FIG. 4) projecting from an end face of outer cylindrical tube 12 at open end 13. In the example shown in FIG. 1, circumferential groove 24 is formed on an outer surface of annular projection 47.

Inner cylindrical tube 14 is configured similar to outer cylindrical tube 12 and includes an open end 36 and a circumferential groove 35 (see FIG. 4) extending around inner cylindrical tube 14 at open end 36. In the example shown in FIG. 1, circumferential groove 35 is also formed as in an outer surface of an annular projection projecting from an end face of inner cylindrical tube 14.

First sleeve holder 16 is screwed into outer cylindrical tube 12 at open end 13 to seal annular space 18 and to support and guide inner cylindrical tube 14. Sleeve holder 16 includes a male threaded portion 20 configured to threadably engage a female threaded portion 22 formed in an inner surface of outer cylindrical tube 12 at open end 13, an engagement portion 26 (see FIG. 3), configured to engage open end 13 of outer cylindrical tube 12, acting as an axial stop when sleeve holder 16 is screwed into outer cylindrical tube 12, and a plurality of circumferentially extending recesses formed in inner and outer surfaces of sleeve holder 16 for receiving one or more sealing gaskets 27, 29.

Seconds sleeve holder 40 is configured substantially similar to first sleeve holder 16, with a male threaded portion 42 configured to threadably engage a female threaded portion 38 formed in inner cylindrical tube 14 at open end 36, an engagement portion 44 (see FIG. 3), acting as an axial stop when sleeve holder 40 is screwed into inner cylindrical tube 14, and one or more circumferentially extending recesses for receiving sealing gaskets 48, 49.

Figure 3:
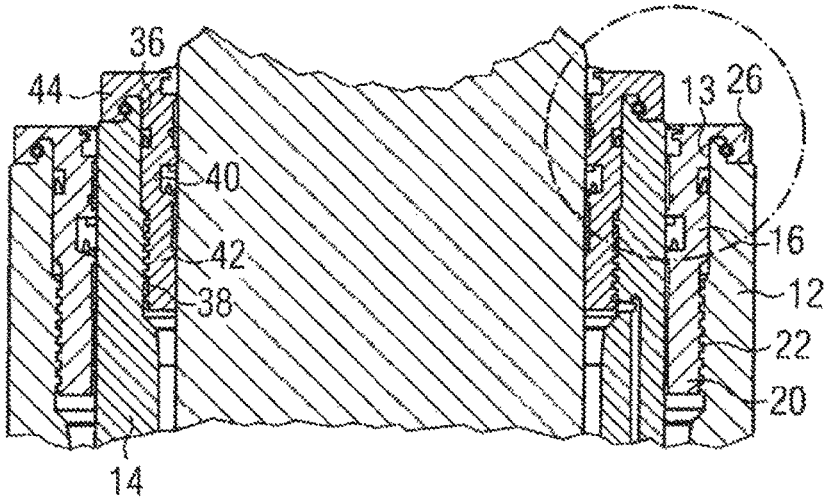
FIG. 3 is a partial cross-sectional view along the line A-A in FIG. 2.
Figure 4:
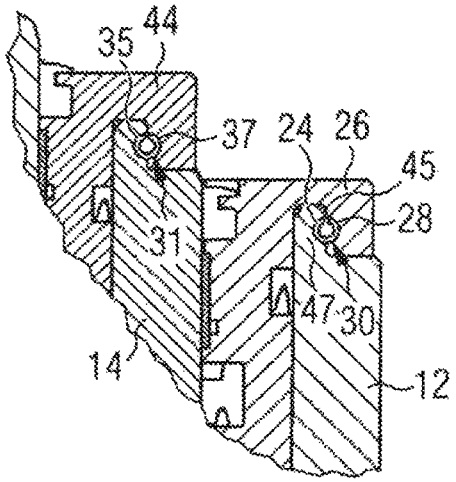
FIG. 4 is an enlarged view of a part of the cross-sectional view of FIG. 3.

Securing of sleeve holder 16 to outer cylindrical tube 12 (and of sleeves holder 40 to inner cylindrical tube 14) will be described in the following with reference to FIGS. 2-4, where FIG. 4 shows an enlarged portion of FIG. 3 designated by the circle in FIG. 3.

Figure 2:
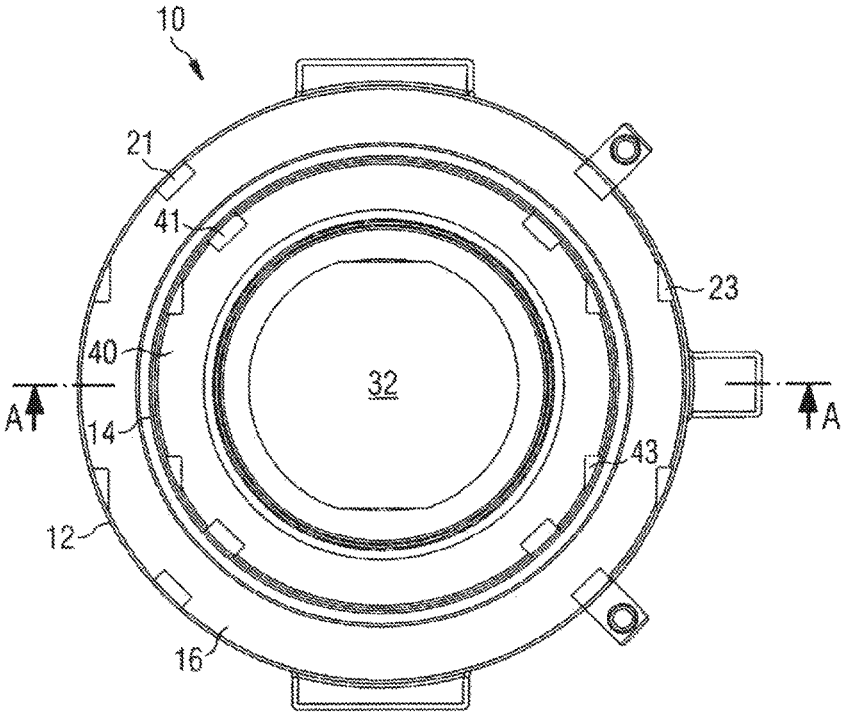
FIG. 2 is a plan view of the hydraulic cylinder shown in FIG. 1.

As shown in FIGS. 2 and 3, in the example, engagement portion 26 is formed as a flange having an inner circumferential groove 45 that is in engagement with annular projection 47 when sleeve holder 16 has been screwed into outer cylindrical tube 12. As shown in FIG. 2, a plurality of radially extending assembly grooves 21 are formed in an end face of sleeve holder 16 for screwing the same into outer cylindrical tube 12 using an appropriate tool.

Further, a tangential bore 28 is formed in sleeve holder 16, namely, extending from an outer surface of sleeve holder 16 tangentially to an inner surface of groove 45 facing outer cylindrical tube 12. In particular, tangential bore 28 is formed such that it is aligned with circumferential groove 24 when sleeve holder 16 has been screwed into outer cylindrical tube 12. In the example shown in FIGS. 1-4, two tangential bores 28 are formed in sleeve holder 16 on opposite sides of the same, and extend through sleeve holder 16. It should be appreciated, however, that in other embodiments, more than two tangential bores or only a single tangential bore 28 may be provided, and that tangential bore 28 may not extend through sleeve holder 16, as long as it extends to the inner surface of groove 45.

After sleeve holder 16 has been screwed into outer cylindrical tube 12 and tangential bore 28 has been aligned with circumferential groove 24, a locking pin 30 is inserted into tangential bore 28 and circumferential groove 24 to secure sleeve holder 16 to outer cylindrical tube 12. In particular, locking pin 30 may prevent movement of sleeve holder 16 in the axial direction, preventing sleeve holder 16 from becoming loose when forces are applied to the same during operation of hydraulic cylinder 10.

As shown in FIG. 2, assembly and disassembly of locking pin 30 is facilitated by providing assembly recesses 23 in sleeve holder 16. Recesses 23 may be formed by end milling or the like, and may allow for insertion of locking pin 30 into tangential bore 28 and removal from the same using, for example, a mandrel or another appropriate tool for inserting and pushing out locking pin 30.

As shown in FIGS. 3 and 4, the configuration of sleeve holder 40 attached to inner cylindrical tube 14 is substantially similar to the configuration of sleeve holder 16, such that a detailed description will be omitted. As shown in FIGS. 2-4, sleeve holder 40 includes assembly grooves 41, a tangential bore 37 configured to be aligned with circumferential groove 35 formed in inner cylindrical tube 14, a locking pin 31 configured to be inserted in outer circumferential groove 35 and tangential bore 37, and recesses 43 for facilitating insertion and removal of locking pin 31.

With the above-described configuration, sleeve holders 16, 40 can be easily and reliably secured to cylindrical tubes 12, 14.

Figure 5:
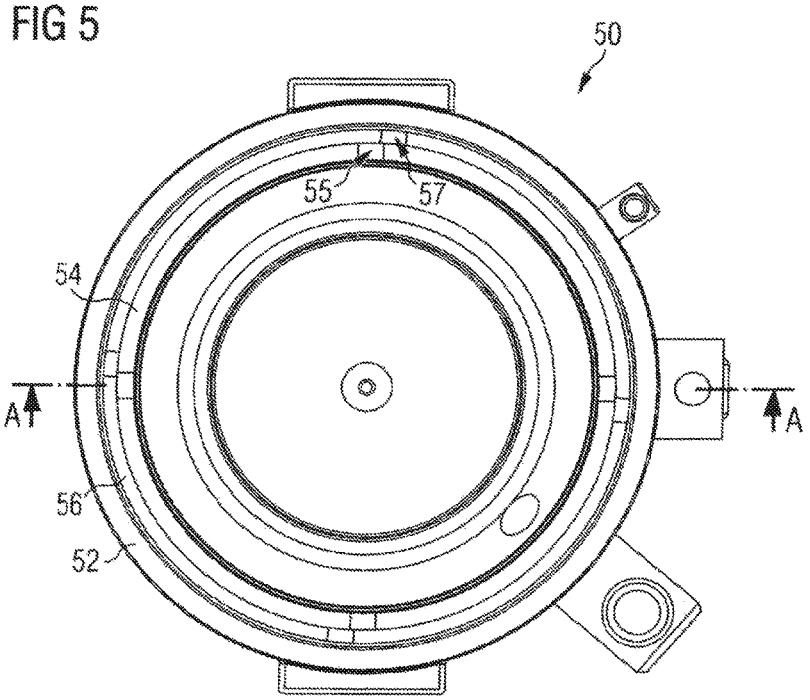
FIG. 5 is a plan view of another exemplary hydraulic cylinder including a sleeve holder in accordance with the present disclosure.
Figure 6:
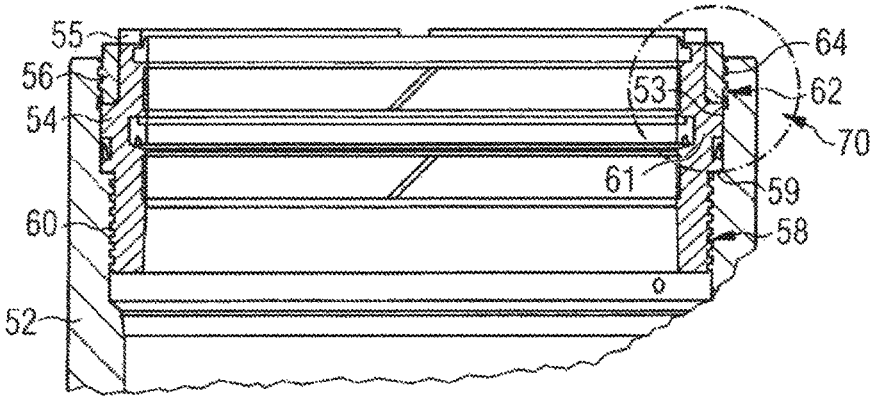
FIG. 6 is a partial cross-sectional view along the line A-A in FIG. 5.
Figure 7:
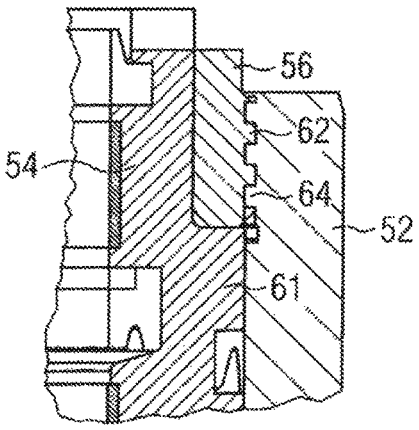
FIG. 7 is an enlarged view of a part of the cross-sectional view of FIG. 6.

FIGS. 5-7 show another example of a sleeve holder for a hydraulic cylinder 50 in accordance with the present disclosure, where FIG. 7 shows an enlarged portion of FIG. 6 designated by the circle in FIG. 6. Hydraulic cylinder 50 is configured substantially similar to hydraulic cylinder 10, such that only the differences will be described in the following.

As shown in FIG. 5, hydraulic cylinder 50, which also may be configured as a telescopic pit prop, includes an outer cylindrical tube 52, an open end 53, a sleeve holder 54 and a locking ring 56. It should be noted that in FIGS. 5-7 the inner cylindrical tube and the piston rod, as well as the associated sleeve holder, are omitted. However, as mentioned above, the configuration of the inner cylindrical tube and the associated sleeve holder may be substantially the same as the configurations of outer cylindrical tube 52 and associated sleeve holder 54 described below.

As shown in FIG. 5, sleeve holder 54 does not include an engagement portion extending over outer cylindrical tube 52. However, sleeve holder 54 also includes a plurality of assembly grooves 55 for screwing sleeve holder 54 into outer cylindrical tube 52 using an appropriate tool. In a similar manner, locking ring 56 also includes a plurality of assembly grooves 57 for screwing locking ring 56 into outer cylindrical tube 52 as described below.

As shown in FIG. 6, sleeve holder 54 and locking ring 56 form a sleeve holder assembly 70 for securing sleeve holder 54 to outer cylindrical tube 52. Sleeve holder 54 includes a male threaded portion 58 having a first pitch, i.e., a right-hand (clockwise) thread or a left-hand (counterclockwise) thread. First male threaded portion 58 mates with a first female threaded portion 60 formed in an inner surface of outer cylindrical tube 52. As shown in FIG. 6, sleeve holder 54 also includes an axial stop in the form of a circumferential flange 61 projecting from an outer surface of sleeve holder 54. When sleeve holder 54 is screwed into outer cylindrical tube 52, a bottom surface of flange 61 abuts against a step 59 formed in the inner surface of outer cylindrical tube 52 to limit movement of sleeve holder 54 into outer cylindrical tube 52.

Locking ring 56, which is formed as a bushing with a counter-rotating thread, includes a second male threaded portion 62 having a second pitch oppositely directed to the first pitch, i.e., a left-hand (counterclockwise) thread or a right-hand (clockwise) thread. Second male threaded portion 62 is configured to engage with a second female threaded portion 64 formed in outer cylindrical tube 52 with a corresponding pitch that is oppositely directed to the pitch of first female threaded portion 60.

After sleeve holder 54 has been screwed into outer cylindrical tube 52, locking ring 56 is threaded into outer cylindrical tube 52 in the opposite direction, until it abuts against an upper surface of flange 61 of sleeve holder 54, to thereby secure sleeve holder 54 to outer cylindrical tube 52. In this manner, if sleeve holder 54 comes loose during operation of hydraulic cylinder 50, rotating in a direction in which sleeve holder 54 is unscrewed from outer cylindrical tube 52, the opposite pitch of second male threaded portion 62 formed on locking ring 56 will result in tightening of sleeve holder 54 against locking ring 56, thereby securing the same.

In order to assure that locking ring 56 does not come loose during operation of hydraulic cylinder 50, additional fastening elements (not shown) may be provided to positively or non-positively secure locking ring 56 to outer cylindrical tube 52. It should be noted, however, that these fastening elements do not have to bear the large loads acting on sleeve holder 54 during operation of hydraulic cylinder 50.

Figure 8:
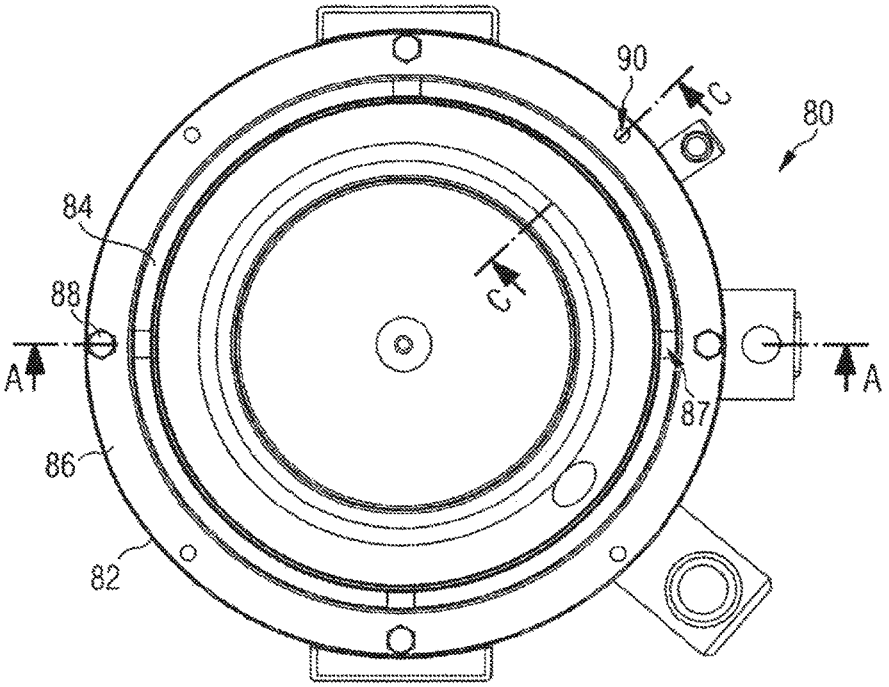
FIG. 8 shows a plan view of another exemplary hydraulic cylinder including a sleeve holder in accordance with the present disclosure.
Figure 9:
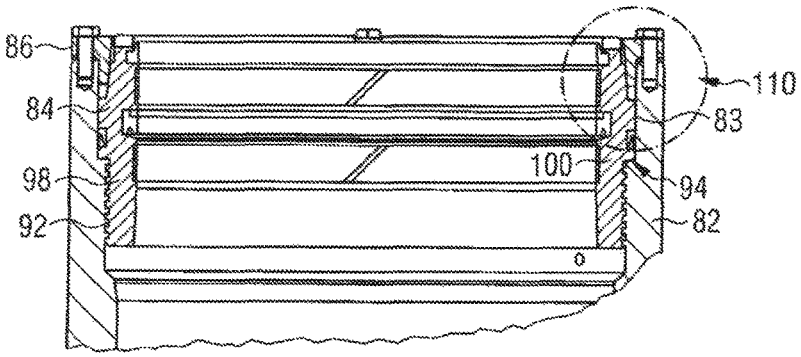
FIG. 9 is a partial cross-sectional view along the line A-A in FIG. 8.
Figure 10:
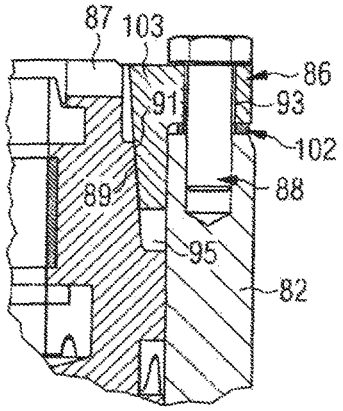
FIG. 10 is an enlarged view of a part of the cross-sectional view of FIG. 9.
Figure 11:
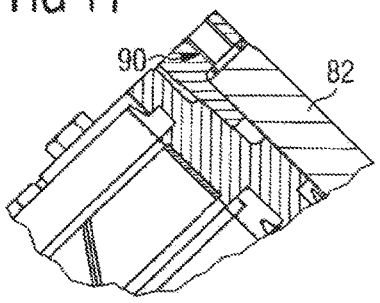
FIG. 11 is a partial cross-sectional view along the line C-C in FIG. 8.

Referring now to FIGS. 8-11, another example of a hydraulic cylinder 80 including a sleeve holder 84 in accordance with the present disclosure is shown. Hydraulic cylinder 80 is configured substantially similar to hydraulic cylinders 10 and 50, which have been previously described, such that only the differences will be discussed in the following. FIG. 10 shows an enlarged part of FIG. 9 designated by the circle in FIG. 9, and FIG. 11 shows a partial cross-sectional view along the line C-C in FIG. 8.

As shown in FIG. 8, hydraulic cylinder 80 includes an outer cylindrical tube 82, a sleeve holder 84 and a tapered locking ring 86 for securing sleeve holder 84 to outer cylindrical tube 82. As shown in FIG. 9, sleeve holder 84 and tapered locking ring form a sleeve holder assembly 110. Again, the inner cylindrical tube and the associated sleeve holder, as well as the piston rod, are not shown in FIGS. 8-11. However, it should be appreciated that the configuration of the inner cylindrical tube and the associated sleeve holder may be substantially similar to the configuration of outer cylindrical tube 82 and sleeve holder 84 described below.

As shown in FIG. 9, outer cylindrical tube 82 includes an open end 83 and a female threaded portion 92 disposed in the vicinity of open end 83. Further, a step 94 may be formed in an inner surface of outer cylindrical tube 82 to serve as an axial stop when sleeve holder 84 is threaded into outer cylindrical tube 82 as described below.

Sleeve holder 84 is configured to threadably engage female threaded portion 92 and includes a male threaded portion 98 formed at a first end of sleeve holder 84 in an axial direction and mating with female threaded portion 92. Sleeve holder 84 further includes a tapered outer surface 91 spaced from male threaded portion 98 in the axial direction and extending toward an opposite second end of sleeve holder 84 in the axial direction to create a wedge-shaped space 95 between sleeve holder 84 and outer cylindrical tube 82 (see FIG. 10). Further, sleeve holder 84 includes a circumferential flange 100 extending from an outer surface of sleeve holder 84 at a position between male threaded portion 98 and tapered outer surface 91 in the axial direction. When sleeve holder 84 is screwed into outer cylindrical tube 82, a bottom surface of flange 100 abuts against step 94 to limit movement of sleeve holder 84 into outer cylindrical tube 82. In this configuration, tapered locking ring 86 is inserted into wedge-shaped space 95. As shown in FIG. 10, tapered locking ring 86 includes a tapered inner surface 89 mating with tapered outer surface 91 of sleeve holder 84. In other words, tapered outer surface 91 of sleeve holder 84 narrows toward the second end of sleeve holder 84, and tapered inner surface 89 of tapered locking ring 86 correspondingly widens toward the first end of sleeve holder 84. The taper angles of tapered inner surface 89 and tapered outer surface 91 may be substantially the same.

As shown in FIGS. 8 and 10, tapered locking ring 86 further includes a plurality of attachment portions 93 for receiving a plurality of fastening elements 88, for example, bolts or the like, for securing tapered locking ring 86 to open end 83 of outer cylindrical tube 82. Further, as also shown in FIGS. 8 and 10, sleeve holder 84 includes a plurality of radially extending assembly grooves 87 for screwing sleeve holder 84 into outer cylindrical tube 82.

As shown in FIG. 10, fastening elements 88 are received in attachment portions 93, which are formed as through holes in a peripheral mounting flange 103 of tapered locking ring 86, and in correspondingly aligned bores formed in open end 83 of outer cylindrical tube 82. When tapered locking ring 86 has been attached to outer cylindrical tube 82, fastening elements 88 do not receive the large loads received by sleeve holder 84 during operation of hydraulic cylinder 80. In addition, if the large loads applied to sleeve holder 84 result in that sleeve holder 84 may tend to come loose, moving in the direction opposite to the direction of screwing sleeve holder 84 into outer cylindrical tube 82, sleeve holder 84 is automatically tightened against tapered locking ring 86 due to the wedge-shape of the same, interlocking with tapered locking ring 86 to secure sleeve holder 84 to outer cylindrical tube 82.

Further, to allow disassembly of tapered locking ring 86 and sleeve holder 84, tapered locking ring 86 includes a plurality of threaded bores 90 distributed in the circumferential direction at positions different from the positions of attachment portions 93. When tapered locking ring 86 and sleeve holder 84 are to be disassembled, a plurality of screws are threaded into threaded bores 90 to push tapered locking ring 86 away from outer cylindrical tube 82. In this manner, tapered locking ring 86 and sleeve holder 84 may be removed from outer cylindrical tube 82.

With the above configuration, sleeve holder 84 may be easily and durably attached to outer cylindrical tube 82. Further, sleeve holder 84 may also be easily removed from outer cylindrical tube 82 if necessary.

While the previous examples have been described in connection with hydraulic cylinders configured as telescopic pit props including both an outer cylindrical tube and an inner cylindrical tube, it should be appreciated that the same sleeve holders can be used in case of a hydraulic cylinder including only an outer cylinder tube and a piston rod received in the same. In such configurations, the corresponding sleeve holder is secured to the outer cylinder tube and supports and guides movement of the piston rod in the cylinder tube.

INDUSTRIAL APPLICABILITY

The industrial applicability of the systems and methods disclosed herein will be readily appreciated from the foregoing discussion. One exemplary application of the sleeve holders disclosed herein are telescopic pit props or moving cylinder units used in underground mining. However, it should be appreciated that the configurations disclosed herein can also be applied to hydraulic cylinders in general, whether they are telescopic or not.

In accordance with some embodiments, a method of securing a sleeve holder to a hydraulic cylinder comprises providing a hydraulic cylinder comprising an outer cylindrical tube including an open end and an outer circumferential groove adjacent to the open end. The method further comprises arranging a movable element in the outer cylindrical tube to be slideably received in the same through the open end. A sleeve holder is threadably engaged with the outer cylindrical tube at the open end to seal an annular space formed between the outer cylindrical tube and the movable element. The sleeve holder includes at least one tangential bore. The method further comprises aligning the at least one tangential bore with the outer circumferential groove formed in the outer cylindrical tube, and inserting at least one locking pin into the outer circumferential groove and the at least one tangential bore to secure the sleeve holder to the outer cylindrical tube.

In accordance with other embodiments, a method of securing a sleeve holder to a hydraulic cylinder comprises providing an outer cylindrical tube including an open end, a first female threaded portion having a first pitch, and a second female threaded portion having a second pitch oppositely directed to the first pitch, the second female threaded portion being disposed closer to the open end than the first female threaded portion. The method further comprises inserting a movable element into the outer cylindrical tube to be slideably received in the same through the open end. A sleeve holder is threadably engaged with the first female threaded portion to seal an annular space formed between the outer cylindrical tube and the movable element. The sleeve holder includes a first male threaded portion mating with the first female threaded portion. The method further comprises threadably engaging a locking ring with the second female threaded portion to secure the sleeve holder to the outer cylindrical tube, the locking ring including a second male threaded portion mating with the second female threaded portion.

In accordance with other embodiments, a method of securing a sleeve holder to a hydraulic cylinder comprises providing an outer cylindrical tube including an open end and a female threaded portion at the open end. The method further comprises inserting a movable element to be slideably received in the outer cylindrical tube through the open end. A sleeve holder is threadably engaged with the female threaded portion to seal an annular space formed between the outer cylindrical tube and the movable element. The sleeve holder includes a male threaded portion mating with the female threaded portion and a tapered outer surface extending toward the open end to create a wedge-shaped space between the sleeve holder and the outer cylindrical tube. The method further comprises inserting a tapered locking ring into the wedge-shaped space and attaching the same to the outer cylindrical tube to secure the sleeve holder to the outer cylindrical tube. The tapered locking ring includes a tapered inner surface mating with the tapered outer surface of the sleeve holder.

It will be appreciated that the foregoing description provides examples of the disclosed systems and methods. However, it is contemplated that other implementations of the disclosure may differ in detail from the foregoing examples. All references to the disclosure or examples thereof are intended to reference the particular example being discussed at that point and are not intended to imply any limitation as to the scope of disclosure more generally. All methods described herein may perform in any suitable order unless otherwise indicated herein or clearly contradicted by context.

Accordingly, this disclosure includes all modifications and equivalences of the subject-matter recited in the claims appended hereto as permitted by applicable law. Moreover, any combination of the above-described elements in all possible variations thereof is encompassed by the disclosure unless otherwise indicated herein or clearly contradicted by context.

Although the preferred embodiments of this disclosure have been described herein, improvements and modifications may be incorporated without departing from the scope of the following claims.

The invention claimed is:

1. A hydraulic cylinder, comprising:

an outer cylindrical tube including an open end, a first female threaded portion, and a second female threaded portion, the second female threaded portion being disposed closer to the open end than the first female threaded portion;

a movable element slideably received in the outer cylindrical tube through the open end;

a sleeve holder threadably engaged with the first female threaded portion to seal an annular space formed between the outer cylindrical tube and the movable element, the sleeve holder including a first male threaded portion mating with the first female threaded portion; and a locking ring threadably engaged with the second female threaded portion to secure the sleeve holder to the outer cylindrical tube, the locking ring including a second male threaded portion mating with the second female threaded portion, wherein the sleeve holder comprises a radially outwardly projecting flange adjacent to the first male threaded portion, the flange configured to serve as an axial stop when the sleeve holder is screwed into the outer cylindrical tube.

2. The hydraulic cylinder according to claim 1, wherein the outer cylindrical tube comprises a inner stepped portion, the flange abutting against the inner stepped portion and limiting movement of the sleeve holder into the outer cylindrical tube when the sleeve holder is threaded into the outer cylindrical tube.

3. The hydraulic cylinder according to claim 1, wherein the locking ring is received in an annular space defined between an inner surface of the outer cylindrical tube and an outer surface of a portion of the sleeve holder extending from the flange towards an end of the sleeve holder opposite to the first male threaded portion, the locking ring abutting against the flange and limiting movement of the sleeve holder in a direction of unscrewing of the sleeve holder from the outer cylindrical tube.

4. The hydraulic cylinder according to claim 1, wherein the sleeve holder further comprises a plurality of first radially extending assembly grooves formed in an end face of the sleeve holder to allow screwing the sleeve holder into the outer cylindrical tube and unscrewing the sleeve holder from the outer cylindrical tube.

5. The hydraulic cylinder according to claim 1, wherein the locking ring further comprises a plurality of second radially extending assembly grooves formed in an end face of the locking ring to allow screwing the locking ring into the outer cylindrical tube and unscrewing the locking ring from the outer cylindrical tube.

6. The hydraulic cylinder according to claim 1, wherein the hydraulic cylinder is configured as a telescopic hydraulic cylinder, the movable element being an inner cylindrical tube configured to slideably receive a piston rod.

7. The hydraulic cylinder according to claim 6, further comprising an inner sleeve holder and an inner locking ring threadably engaged with the inner cylindrical tube, the inner sleeve holder and the inner locking ring having the same configuration as the sleeve holder and the locking ring.

8. The hydraulic cylinder according to claim 1, wherein the second female threaded portion of the outer cylindrical tube and the sleeve holder define an annular gap there between, and wherein the locking ring is disposed within the annular gap when the locking ring is threadably engaged by the second female threaded portion.

9. The hydraulic cylinder according to claim 1, wherein the first female threaded portion has a first pitch so that the sleeve holder is screwed into the outer cylindrical tube in a first direction, and the second female threaded portion has a second pitch that is oppositely directed to the first pitch so that the locking ring is screwed into the outer cylindrical tube in a second direction that is opposite the first direction.

10. The hydraulic cylinder according to claim 1, wherein the first female threaded portion has a first threaded portion inner diameter and the second female threaded portion has a second threaded portion inner diameter that is greater than the first threaded portion inner diameter.

* * * * *